United States Patent [19]

Nabb et al.

[11] Patent Number: 4,512,597

[45] Date of Patent: Apr. 23, 1985

[54] DOOR LOCK

[75] Inventors: Elis Nabb, Björkboda; Stig Eggert, Kärra, both of Finland

[73] Assignee: Oy Wärtsilä Ab, Helskinki, Finland

[21] Appl. No.: 512,103

[22] Filed: Jul. 7, 1983

[30] Foreign Application Priority Data

Jul. 12, 1982 [FI] Finland ..... 822469
Jan. 26, 1983 [FI] Finland ..... 830279

[51] Int. Cl.[3] ..... E05B 1/16
[52] U.S. Cl. ..... 292/143; 292/252
[58] Field of Search ..... 292/143, 252, 191, 192, 292/150, 41; 70/34

[56] References Cited

U.S. PATENT DOCUMENTS 1,541,093 6/1925 Amico ..... 292/150
1,748,599 2/1930 Dermody ..... 292/150 X
2,383,576 8/1945 Wiley ..... 292/252
4,111,477 9/1978 Rigali ..... 292/252
4,183,565 1/1980 Allemann ..... 292/150 X

*Primary Examiner*—Richard E. Moore
*Attorney, Agent, or Firm*—John Smith-Hill

[57] ABSTRACT

A door lock comprises a bolt and a mechanism for moving the bolt between a protruding locking position and a withdrawn unlocking position. The bolt is provided, in its protruding part, with at least one auxiliary locking element, such as a ball, a pin or the like, movable in a transverse duct in the bolt between a first position, in which it partly extends outside the sides of the bolt, and a second retracted position. In the bolt, there is also an operating member moving in the longitudinal direction of the bolt. This member is arranged to move each auxiliary locking element into its first position, when the bolt reaches its protruding position. Preferably, the bolt is provided with two auxiliary locking elements moving symmetrically with regard to a longitudinal plane of the bolt.

14 Claims, 3 Drawing Figures

Fig. 1
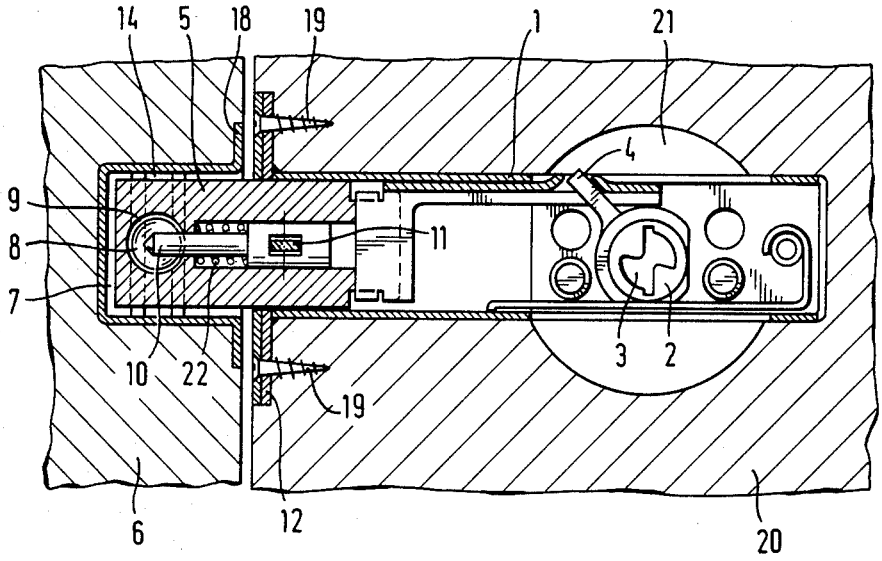
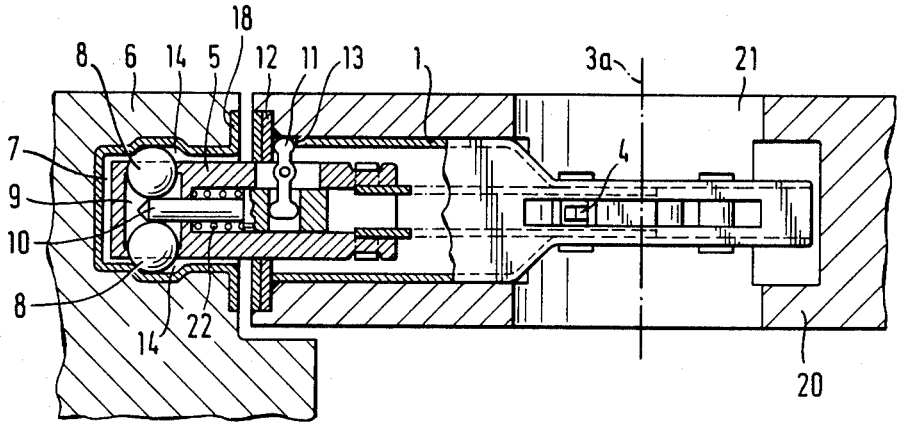
Fig. 2

DOOR LOCK

The invention relates to a door lock with a bolt and a mechanism for moving the bolt between a protruding locking position and a retracted unlocking position.

One way of breaking a door lock open, is to press the bolt with a great force to move back into the lock. Another way is to enlarge the slot between the door and the door frame so much that the bolt comes out from the bolt receiving housing in the door frame. The latter way of breaking a door lock may be successful mostly because the bolt is in no way locked to the door frame, but is free to move relatively thereto.

The object of the invention is to improve the security of a door lock by providing the bolt with a mechanism locking the bolt to the door frame. A door lock according to the invention should work in the same way as a normal door lock, that is, when the door is locked, the bolt prevents the door from swinging into open positon. According to the invention, there is a mechanism in the bolt preventing the bolt from moving out of the bolt housing in the door frame. This mechanism should be simple and must not essentially affect the traditional construction of a door lock. It must be possible to lock and unlock the door through a simple operation, such as a simple turning of a key or a handle.

So called hook bolts are previously known. They are used in sliding doors to lock the bolt to the door frame in the sliding direction of the door. Such a design is shown in German Patent Publication No. 425 971. In this case the bolt itself or a part thereof must perform a vertical movement, which considerably complicates the construction of the bolt and the bolt mechanism. It is also known to use ball elements as locking members. U.S. Pat. No. 4,015,456 discloses a design, where a cylindrical locking member and the member to be locked move in the same direction. The unlocking of this known lock is a complicated operation requiring a special tool, and hence, this design is not applicable to door locks. Also in padlocks ball elements are commonly used as locking members. The main problem in applying ball-locking or similar solutions to door locks, relates to the moving of the balls into locking and releasing position in exactly the right moment with regard to the movements of the lock bolt. This should happen without applying special additional operations.

According to the invention there is provided a door lock, comprising a bolt and a mechanism for moving said bolt between a protruding locking position and a withdrawn unlocking position, said bolt being provided, in its protruding portion, with at least one auxiliary locking element movable in a transverse cavity in said bolt between a first outer position, in which it partly extends outside a lateral surface of said bolt and a second retracted position, said bolt being further provided with an operating member movable in the longitudinal direction of the bolt, said operating member being arranged to move said auxiliary locking element into its first position, when said bolt reaches said protruding postion.

In a lock embodying the invention, an efficient locking is obtained in two directions perpendicular to each other.

In a preferred embodiment of the invention, two auxiliary locking elements are used in the door lock bolt, for instance, balls, pins or the like, which move symmetrically in relation to a longitudinal plane of the lock bolt. Preferably, the auxiliary locking elements are made to protrude from the vertical sides of the bolt. If the bolt is very thin, it may be necessary to arrange the auxiliary locking elements so, that they protrude from the upper and under side of the bolt. This is a less favourable solution, because in the vertical direction a greater clearance is usually needed between the housing in the door frame and the bolt.

For moving the auxiliary locking elements an operating member is used moving in the longitudinal direction of the bolt. The operating member has an oblique surface for each auxiliary locking element giving the element an outward movement, when the operating member moves longitudinally. Adjacent to the oblique surface the operating member has a portion extending in the longitudinal direction of the bolt, which portion keeps the auxiliary locking elements locked in their protruding position. When the inner portions of the auxiliary locking elements are supported by this longitudinally directed surface of the operating member, not even a great force can press the auxiliary locking elements inwards.

For moving the operating member, normal operation of the lock must be sufficient. The auxiliary locking elements should be positively guided into their protruding position, when the bolt reaches its protruding position. One embodiment is based on the use of a lever, pivotally journalled in the bolt. When the bolt approaches its protruding position, the lever engages a stationary portion of the lock case or the door. This causes turning of the lever and this movement is transmitted to the operating member, which, due to the action of the lever moves longitudinally and pushes the auxiliary locking elements outwards into their protruding position. The lever is positively guided by the lock case so that, when the bolt starts its movement from its locking position to its releasing position, the lever forces the operating member to retract from the position keeping the auxiliary locking elements in their protruding position, thereby allowing them to withdraw into a transverse cavity housing them in the bolt. The retraction of the operating member can also be carried out or effectuated by a spring.

For moving the operating member, also other elements than a lever can be used, for example, a pair of activating elements such as balls or the like. There should then be a second transverse cavity in the bolt and suitable guiding surfaces in the lock case operating the activating elements to move relatively to the bolt. Further, there should be an oblique surfaces in the operating member for giving the activating elements a movement in an outwards direction relatively to the bolt.

The invention will how be described, by way of example, with reference to the accorpaying drawing, in which FIG. 1 is a longitudinal section of a door lock according to the invention;

FIG. 2 is a top view of the door lock of FIG. 1, partly in section,

Figure 3:
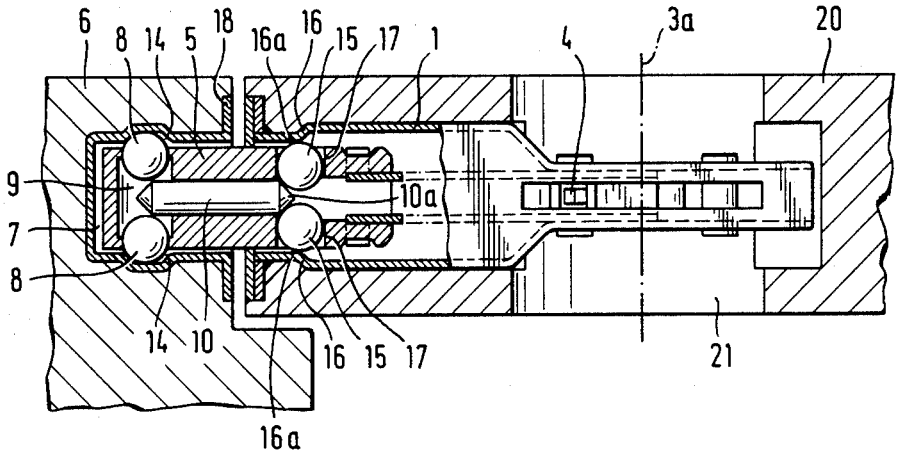
FIG. 3 is a top view of another embodiment of the invention, partly in section.

In the drawing, 20 indicates a door being provided with a door lock comprising a lock case 1 and a force transmission member, a so-called follower 2. The follower has a central opening 3, to which a cylinder lock mechanism or a handle is connectable. The follower 2 is rotatably journalled in the lock case 1 to turn about its central axis 3*a*, thereby operating a lock bolt 5 by means of a lever 4. There is a through-going bore 21 in the door 20 allowing mounting of a cylinder lock or a handle assembly to cooperate with the follower 2. The bolt 5 is shown in its protruding locking position. Its outer end is received by a bolt housing 7 in a stationary door frame 6. In FIG. 1, the lever 4 has not quite reached its final bolt dead-locking position. To reach this position it has to be turned a few degrees more in an anti-clockwise direction.

As evident from FIG. 2, there are two auxiliary locking elements in the form of two balls 8 in the outer portion of the lock bolt 5. The balls 8 move in a horizontal through-going bore 9. The outer edges of this bore have, after the insertion of the balls 8, been pressed slightly inwards, so that the balls 8 do not come out further from the bore 9, than what is shown in FIG. 2. When the lock bolt 5, under the influence of the lever 4, approaches its protruding position shown in the drawing, an operating member 10, slidably mounted in the bolt 5, affects the balls 8, so that they are pushed out into the position shown in FIG. 2. The movement of the operating member 10 is caused by a lever 11 pivoted in the bolt 5. Because of the movement of the bolt 5, the lever 11 engages a stationary portion 12 of the lock case 1, which causes the lever 11 to turn, so that its inner end forces the operating member 10 into the position shown in FIG. 2. In this position, the tapered end of the operating member 10 penetrates in between the balls 8 and passes the position of the centers of the balls 8. This means that the balls 8 are supported by the side surfaces of the operating member, and these side surfaces extend in the longitudinal direction of the bolt. In this position, the balls 8 are firmly locked in their protruding position. When the bolt 5 is retracted by means of the follower 2, the lever 11 is turned in the opposite direction, because its outer end is in an opening 13 in the lock case. The rear edge of this opening transmits a force to the lever 11, which effects retraction of the operating member 10. This happens simultaneously with the retraction of the bolt 5. Hence, for obtaining the desired function, a sufficient clearance for the balls 8 must be present in the ball receiving recesses 14 in the side surfaces of the bolt housing 7 in the door frame. Retraction of the operating member is assisted by a spring 22.

In the embodiment shown in FIG. 3, the lever 11 is replaced by a pair of activating elements in the form of balls 15, moving in a bore 17. When the bolt 5 moves into its protruding position, the balls 15 are moved by oblique surfaces 16 in the lock case 1 towards each other and reach the position shown in FIG. 3. Simultaneously, the balls 15, pressing against the oblique inner end surfaces **10*a* of the operating member 10, push the operating member 10 to the left into a position forcing the balls 8 into their protruding position. This embodiment has a better and more reliable function than the one shown in FIGS. 1 and 2. Another advantage is that the clearance in the ball receiving recesses 14, which reduces the locking effect of the balls 8, can be made considerably smaller due to the fact that the lateral support keeping the balls 8 in their protruding position is present in the form of two parallel side surfaces 16*a* in the lock case 1 and not in the operating member 10. Hence, the locking balls 8 can move against each other almost immediately when the bolt starts to move to the right back into the lock casing from its protruding position shown in FIG. 3**.

The invention is not restricted only to the described embodiments, but several variations and modifications thereof are feasible within the scope of the attached claims.

We claim:

1. A door lock, comprising a bolt and a mechanism for moving said bolt between a protruding locking position and a withdrawn unlocking position, said bolt being provided, in its protruding portion, with at least one auxiliary locking element movable in a transverse cavity in said bolt between a first outer position, in which it partly extends outside a lateral surface of said bolt, and a second retracted position, said bolt being further provided with an operating member movable in the longitudinal direction of the bolt and arranged to move said auxiliary locking element into its first position when said bolt reaches said protruding position, and a lever pivoted to the bolt, which lever, when said bolt approaches its protruding position, is arranged to meet a portion stationary with respect to said lock, whereby said pivoted lever is turned and thereby forces said operating member in a longitudinal direction of said bolt to bring said auxiliary locking element into its first position.

2. A door lock according to claim 1, in which said bolt is provided with two auxiliary locking elements moving symmetrically with regard to a longitudinal plane of said bolt.

3. A door lock according to claim 1, in which said lever is positively guided by a portion stationary with respect to said lock, said portion being arranged to turn said lever so that it retracts said operating member when said bolt starts to move back from its locking position towards its unlocking position, thereby allowing said auxiliary locking element to reach its second position.

4. A door lock according to claim 1, in which said bolt has a pair of vertical sides and said auxiliary locking element is arranged to protrude from one of said vertical sides of said bolt.

5. A door lock according to claim 1, in which said operating member has an oblique guiding surface cooperating with said auxiliary locking element to transmit a movement thereto, said operating member also having a portion directed in the longitudinal direction of said bolt, which portion is arranged to lock said auxiliary locking element in its first position.

6. A door lock, comprising:

a lock casing;

an elongate bolt fitted in the casing and having a forward portion and a rearward portion, said bolt being movable longitudinally in the casing between a protruding locking position, in which the forward portion of the bolt projects from the lock casing for engaging a bolt cavity in a door jamb and the rearward portion of the bolt remains in the door casing, and a retracted unlocking position, in which the forward portion of the bolt does not project substantially from the lock casing, the bolt also having a lateral surface bounding said forward portion and being formed with a transverse cavity which opens to said lateral surface;

a mechanism for moving said bolt between said protruding position and said retracted position;

at least one auxiliary locking element movable in said transverse cavity between a first outer position, in which it partly extends outwardly of the bolt beyond said lateral surface for engaging a recess in a wall of the bolt cavity, and a second retracted position;

an operating member fitted in the bolt and movable in the longitudinal direction thereof for moving the auxiliary locking element into its first position when the bolt reaches said protruding position; and actuating means carried by the bolt and adapted to engage the lock casing when the bolt is moved to its protruding position, whereby the actuating means are caused to cooperate with the operating member to bring about longitudinal movement thereof.

7. A door lock according to claim 6, in which said bolt has a second transverse cavity, and the actuating means comprise at least one activating element arranged in the second transverse cavity to move in relation to said operating member, and said lock has a guiding surface arranged to guide movement of said activating element, forcing said activating element in a direction against said operating member when said bolt reaches its protruding position and releasing said activating element to move away from said operating member when said bolt moves back from its protruding position, whereby the activating element controls the movement of the operating member.

8. A door lock according to claim 7, in which said activating element has the form of a body of revolution.

9. A door lock according to claim 7, in which said operating member has an oblique surface cooperating with said activating element for moving said operating member longitudinally.

10. A door lock according to claim 6, in which said bolt has a pair of vertical sides and said auxiliary locking element is arranged to protrude from one of said vertical sides of said bolt.

11. A door lock according to claim 6, in which said operating member has an oblique guiding surface cooperating with said auxiliary locking element to transmit a movement thereto, said operating member also having a portion directed in the longitudinal direction of said bolt, which portion is arranged to lock said auxiliary locking element in its first position.

12. A door lock according to claim 6, in which said bolt is provided with two auxiliary locking elements moving symmetrically with regard to a longitudinal plane of said bolt.

13. A door lock according to claim 6, wherein the actuating means comprise a lever pivoted to the bolt, which lever, when said bolt approaches its protruding position, is arranged to meet a portion stationary with respect to said lock, whereby said pivoted lever is turned and thereby forces said operating member in a longitudinal direction of the bolt to bring said auxiliary locking element into its outer position.

14. A door lock according to claim 13, wherein said lever is positively guided by a portion stationary with respect to said lock, said portion being arranged to turn said lever so that it retracts said operating member when said bolt starts to move back from its protruding position towards its retracted position, thereby allowing said auxiliary locking element to reach its second position.

* * * * *